US006273287B1

(12) United States Patent
Witter et al.

(10) Patent No.: US 6,273,287 B1
(45) Date of Patent: Aug. 14, 2001

(54) VACUUM-RELIEF VALVE FOR THE FLOATING ROOFS OF TANKS FOR STORING LIQUIDS

(75) Inventors: Aldyr Witter, *deceased*, late of Sao Leopoldo, by Roger Witter, legal representative; Luis Adolfo Velloso Pradel, Porto Alegre, both of (BR)

(73) Assignee: Petroleo Brasileiro S.A. - Petrobras (BR)

( * ) Notice: Subject to any disclaimer, the term of this patent is extended or adjusted under 35 U.S.C. 154(b) by 0 days.

(21) Appl. No.: 09/056,753

(22) Filed: Apr. 8, 1998

(Under 37 CFR 1.47)

(30) Foreign Application Priority Data

Apr. 8, 1997 (BR) ..... 9701718

(51) Int. Cl.[7] ..... B65D 90/34
(52) U.S. Cl. ..... 220/227; 220/220
(58) Field of Search ..... 220/216, 219, 220/220, 227

(56) References Cited

U.S. PATENT DOCUMENTS 1,493,091 5/1924 Wiggins .
2,536,077 1/1951 Orr .
3,883,032 * 5/1975 Fisher ..... 220/219
5,230,436 7/1993 Vaughn .
5,353,941 10/1994 Benvegnu .

* cited by examiner

*Primary Examiner*—Nathan J. Newhouse
(74) *Attorney, Agent, or Firm*—Nixon & Vanderhye PC

(57) ABSTRACT

The present invention relates to a device which is used in the floating roofs of tanks for storing liquids and is intended to prevent the formation of a vacuum between the stored liquid and the floating roof (5). More particularly, the device of the invention is intended for a liquid storage tank which has operating heights which are much lower than the maintenance height.

There are two possible ways in which the device of the invention can operate. When the floating roof (5) is in operating mode and reaches its minimum operating height (FIG. 2), a lower shaft stop (10) of a sliding shaft of the valve comes against a lower stop (8) of the body (2) of the device, causing the device (30) to open.

When the floating roof (5) is placed in the maintenance mode, use is made of a locking pin (4) for rigidly fastening the sliding shaft (3) to the body (2) of the device (30), which enables the assembly to open when the floating roof reaches the maintenance height (FIG. 4).

18 Claims, 5 Drawing Sheets

VACUUM-RELIEF VALVE FOR THE FLOATING ROOFS OF TANKS FOR STORING LIQUIDS

FIELD OF THE INVENTION

The present invention relates to a device which is to be installed in the floating roofs of tanks for storing liquids and which is intended to prevent the formation of a vacuum inside the tank.

BASIS OF THE INVENTION

There are two possible ways in which the device of the invention can operate. When the floating roof is in operating mode and reaches a minimum operating height, a lower stop of a sliding shaft comes up against a lower stop of the body of the device, causing the vacuum-relief valve to open.

When the floating roof is placed in the maintenance mode, use is made of a locking pin for rigidly fastening the sliding shaft to the body of the device, which enables the vacuum-relief valve to open when the floating roof reaches the maintenance height.

PRIOR ART

Storage tanks are widely used in the petroleum industry and are essential to the functioning of an operational unit. They may be intended, for example, for storing crude oil, intermediate products and final products.

Given the highly volatile nature of these products, in the storage tanks use is made of a roof capable of floating over the stored liquid, as a way of preventing the undesirable accumulation of gases between the layer of liquid and the roof.

Tanks which are currently used, especially those of large capacity, generally have a bottom which is in the form of an upwardly convex cap or cone, i.e. with the centre higher than the edges. Undesirable liquids, which are generally heavier than the products stored, are frequently dispersed within the liquid mass. Because they are heavier, these undesirable liquids have a tendency to be deposited on the bottom of the tanks.

As the structural characteristics of the bottom of the tank do not favour draining-off of these undesirable liquids, an extensive layer of sludge is usually formed on the bottom of the tank.

As the product stored inside the tank is drained off, the floating roof descends. There is a limit on the descent of the floating roof which, in theory, could descend until it touches the bottom of the tank.

However owing to the formation of the layer of sludge, which in some cases may reach as far as one fifth of the way up the tank, it becomes necessary to limit the descent of the floating roof at such a height that contact between the roof and the layer of sludge is prevented, since contact could compromise the integrity of the floating roof. This minimum height which the floating roof may reach is referred to by specialists as the "minimum operating height".

Support legs which are rigidly fastened to the floating roof are preadjusted to touch the bottom of the tank when the floating roof descends as far as the minimum operating height. Even if the level of liquid falls, the floating roof remains in the operating position, supported by the support legs.

In this situation, under the floating roof a vacuum would be formed which could give rise to the structural collapse of the roof, on account of its large external free surface area being subjected to atmospheric pressure.

To prevent the formation of a vacuum, devices are used which enable the internal and external pressures to be equalized, such devices being referred to by specialists as "vacuum-relief valves", which are installed in the floating roof.

The vacuum-relief valves which are currently used basically comprise a body which can slide inside a casing. At the top of the body there is a cover which sits on the upper edges of the casing, prevents the assembly from falling inside the tank, and acts as an element for closing the vacuum-relief valve.

At the bottom of the body there is a shaft which extends vertically to the bottom of the tank. The length of the shaft is such that, when the floating roof approaches the minimum operating height, the shaft touches the bottom of the tank and, as a result, the body is forced to move upwards, inside the casing, causing the valve to open.

When it is necessary to place the storage tank in maintenance mode, all the liquid has to be drained off from inside the tank and the floating roof has to descend as far as a specific height which enables maintenance teams to access the inside of the tank, this height being the "maintenance height" as referred to by specialists. In this situation, the adjustment of the support legs has to be changed since the maintenance height is normally slightly higher than the minimum operating height.

The vacuum-relief valves described above operate perfectly with liquid-storage tanks constructed according to current techniques, where the maintenance height and the minimum operating height are very similar. However, the introduction of a new technique for constructing the bottom of the liquid-storage tanks has made this type of vacuum-relief valve unsuitable for this function, as will be demonstrated hereinbelow.

Our International Patent Application PCT/BR97/00022 proposes the use of a tank bottom whose centre is located at a level below the level of the edges, with a view to concentrating, in the central region of the bottom, the undesirable liquids which are to be drained off. A ramp drains these liquids off to the edges, where they are drained off to the outside.

This novel type of tank bottom made it possible for the floating roof of the tank to descend as far as a position much closer to the bottom than had previously been achieved, since the removal of the undesirable liquids from the bottom of the tank practically eliminates the formation of the layer of sludge. As the maintenance height remains the same, the difference between it and the minimum operating height becomes very large. Consequently, it became necessary to revise the design of the support legs and of the vacuum-relief valves.

Our International Patent Application PCT/BR98/00007 proposes the use of an assembly for supporting floating roofs in which a support leg slides inside a guide. The guide acts as support for the floating roof when the roof descends as far as the minimum operating height. The support leg has a structural function only when the floating roof is placed in maintenance mode. In this situation, a locking pin locks the support leg in the position in which it has to remain in order to support the floating roof.

Nevertheless, there remains the problem of the vacuum-relief valves known hitherto being unsuitable for the new type of storage tank. If conventional vacuum-relief valves were to be used in the floating roofs of these tanks, a major problem would arise since the valves would open when the floating roof reached the maintenance height, and would remain open from then on.

When the floating roof reaches the minimum operating height, most of the length of the shaft would be above the roof and a body surrounding the shaft could even be entirely outside the casing, located at a significant height above the top of the floating roof, like a post.

Such an occurrence would cause a great deal of damage, since the shaft is not designed to operate in this way and would possibly buckle. One solution would be to strengthen the shaft and the casing. However, such a measure would give rise to an undesirable increase in the weight of the assembly and, as a result, of the floating roof. It therefore became necessary to design a new type of vacuum-relief valve which would solve the problems described above.

The present invention proposes the use of a vacuum-relief valve which has a double action, which solves the problems described above.

SUMMARY OF THE INVENTION

The present invention relates to a device which is to be installed in the floating roofs of tanks for storing liquids, and is intended to prevent the formation of a vacuum between the floating roof and the layer of liquid.

The vacuum-relief valve of the present invention is characterised by the features of claim 1.

When the floating roof is in the operating mode and in an intermediate position, the shaft of the vacuum-relief valve rests on its upper shaft stop. The upper body stop rests on the top of the casing and operates as a plug, closing off communication between the inside of the tank and the outside atmosphere.

When the floating roof descends and the bottom of the shaft of the vacuum-relief valve touches the bottom of the tank, the shaft starts to slide inside the body, causing the lower body stop to approach the lower shaft stop.

Shortly before the floating roof descends as far as the minimum operating height, the lower body stop touches the lower shaft stop and the shaft is prevented from continuing its sliding movement inside the body, the two components remaining secured together and stationary. When the descent of the floating roof continues the casing also descends, causing the upper shaft stop to move away from the top of the casing, which causes the vacuum-relief valve to open.

When the floating roof again rises, the casing will accompany it and there will again be sliding between it and the body, this time in the opposite direction, until the upper body stop once again rests on the top of the casing, closing the vacuum-relief valve.

The locking pin comprises a body which has a shaft at one of its ends, the shaft having a stop flange at the other end. The upper end of the body has means for handling the locking pin. The locking pin has means which enable it to be fastened to the shaft of the vacuum-relief valve.

In order to adjust the vacuum-relief valves so that they will operate with the floating roof in the maintenance mode, the shaft of the locking pin is passed through the orifices in the plates and the shaft of the locking pin then acts as a stop for the shaft of the vacuum-relief valve.

When the shaft of the vacuum-relief valve touches the bottom of the tank, the upper stop of the body of the vacuum-relief valve is prevented from continuing to rest on the top of the casing. These components then separate, causing the vacuum-relief valve to open.

The orientation of the locking pin indicates the status of the vacuum-relief valve (operating mode or maintenance mode) to a remote observer.

BRIEF DESCRIPTION OF THE DRAWINGS

The characteristics of the present invention will be better understood on the basis of the detailed description which will be given hereinbelow, purely by way of example, in combination with the accompanying drawings which are an integral part of the present specification and in which.

DESCRIPTION OF A PREFERRED EMBODIMENT

Figure 1:
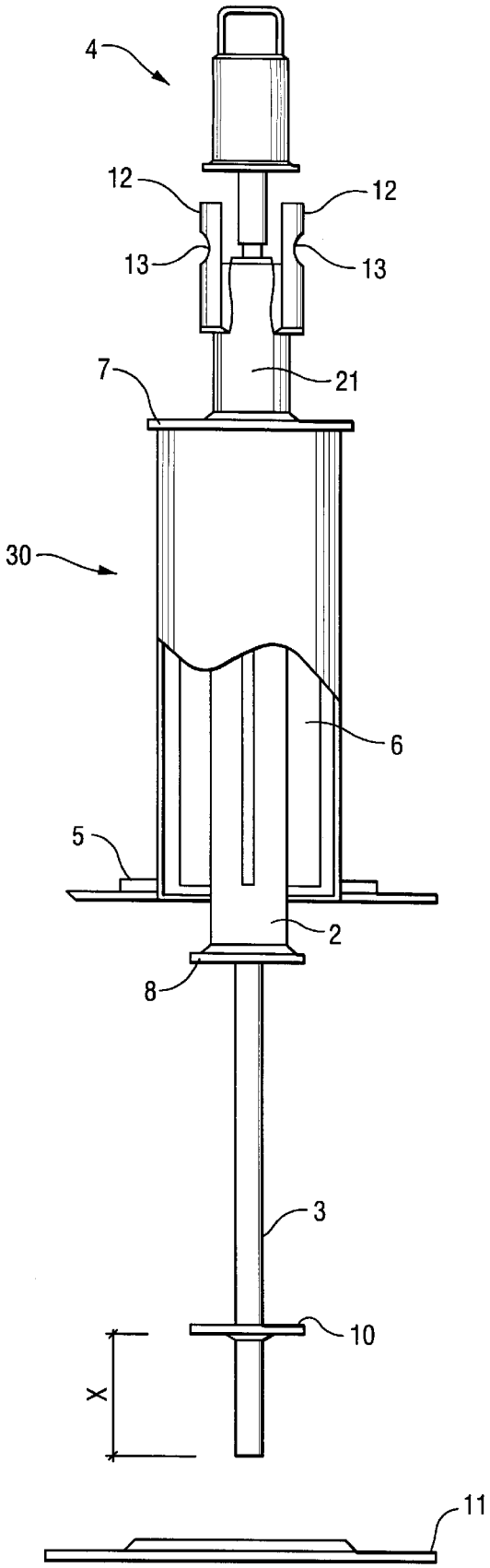
FIG. 1 is a schematic view of a vacuum-relief valve installed in a floating roof which is in operating mode.
Figure 2:
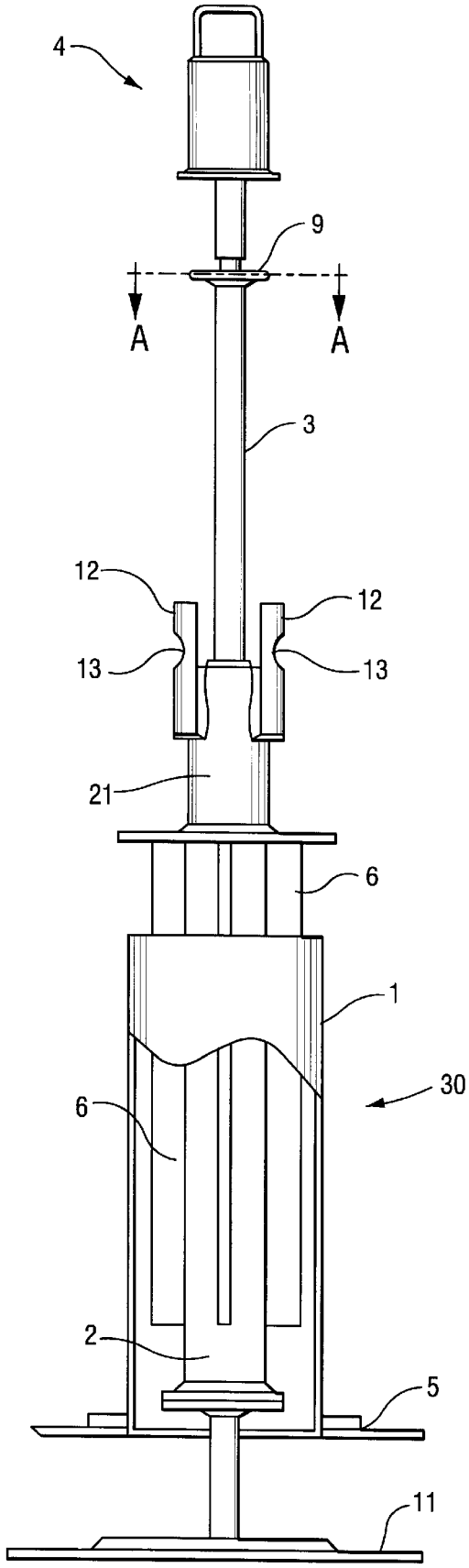
FIG. 2 is a schematic view of a vacuum-relief valve installed in a floating roof which is in operating mode, when the bottom of the shaft of the vacuum-relief valve is resting on the bottom of the tank.
Figure 2A:
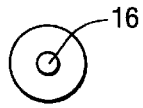
FIG. 2A is a cross sectional view taken along line A—A of FIG. 2.

FIGS. 1, 2, 3 and 4 are side views of the vacuum-relief valve 30 of the present invention, the valve being fastened to a floating roof 5 of a tank for storing liquid products. The roof 5 includes means giving it positive buoyancy. Purely for the purposes of simplifying the drawings, the Figures show only one vacuum-relief valve 30. However, it is known that a plurality of vacuum-relief valves is normally used in one floating roof.

The vacuum-relief valve 30 basically comprises a casing 1, a body 2, a shaft 3 and a locking pin 4. The casing 1 is a substantially vertical, hollow component rigidly fastened to the floating roof 5. The body 2 is substantially vertical and is installed inside the casing 1, so as to be able to slide freely. In the present embodiment, the body 2 has fins 6 which are intended to guide the body 2 slidably so as to keep its longitudinal axis substantially parallel to the longitudinal axis of the casing 1.

Figure 3:
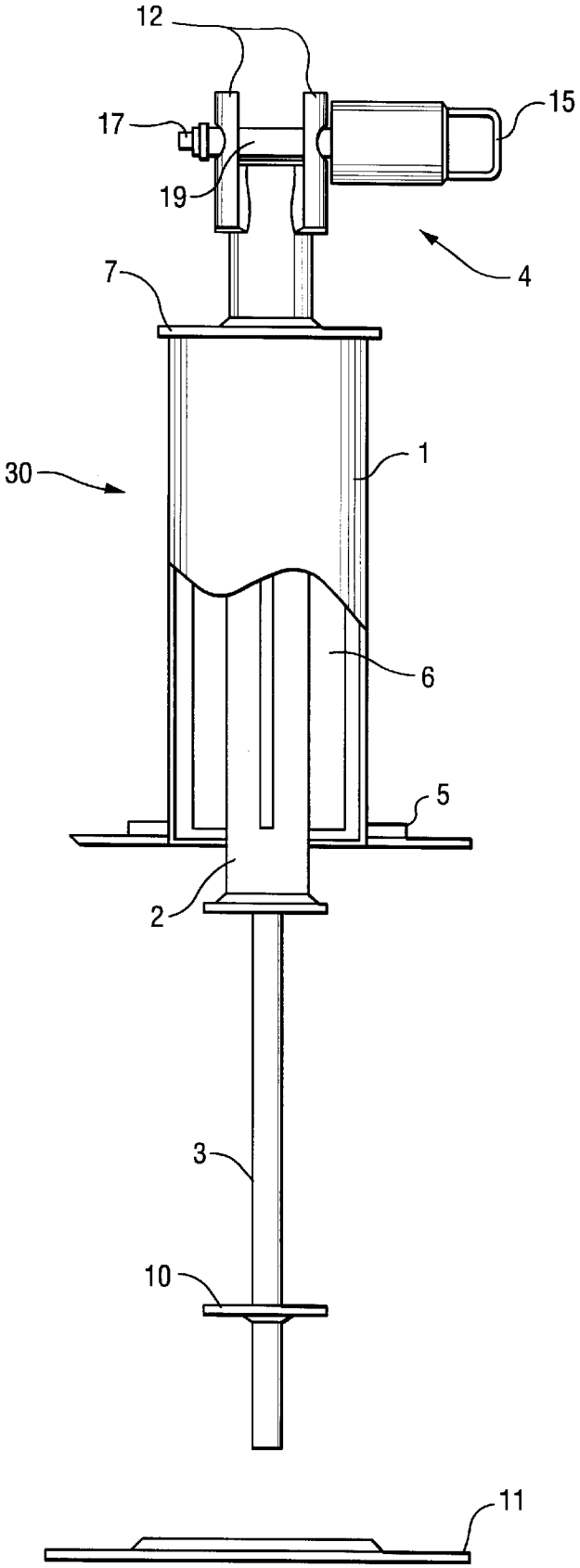
FIG. 3 is a schematic view of a vacuum-relief valve in a floating roof in which the floating roof is ready to descend to a maintenance height.
Figure 4:
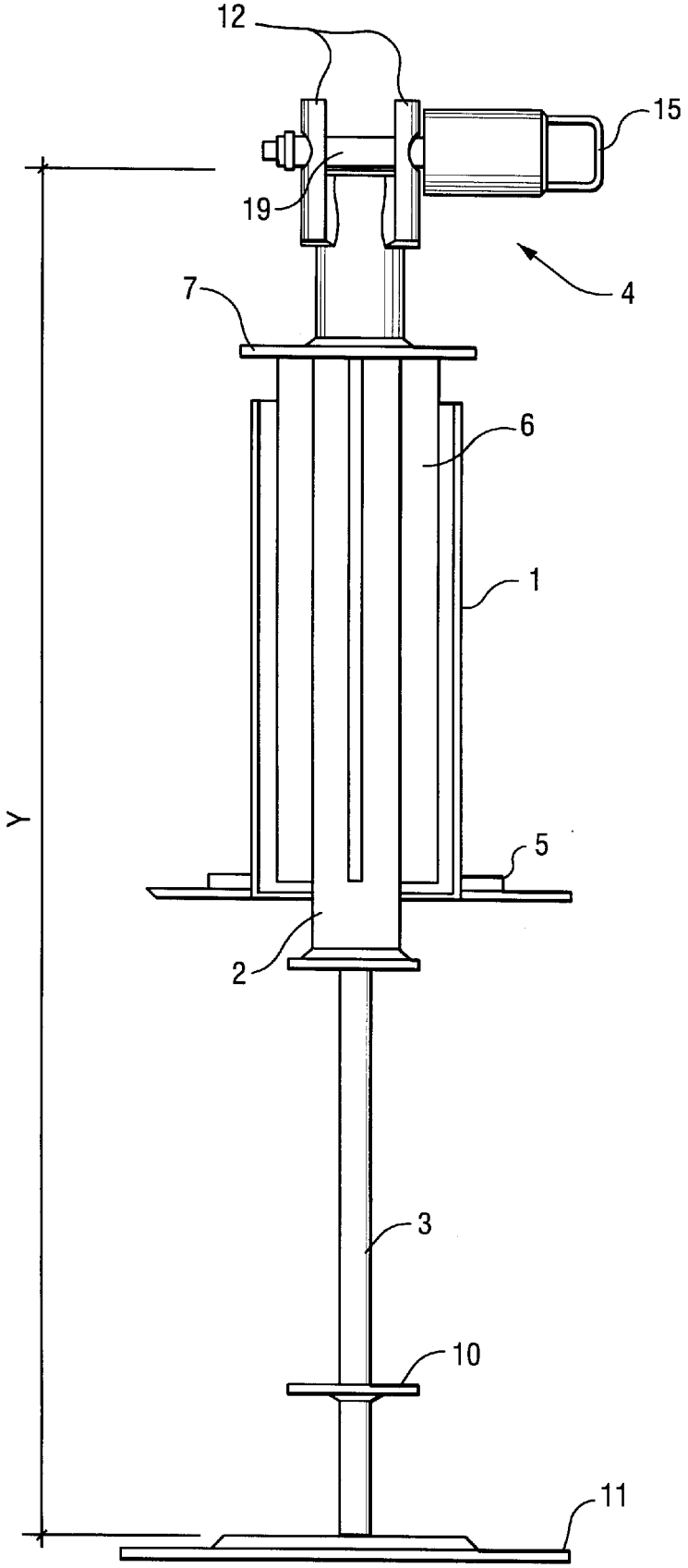
FIG. 4 is a schematic view of a vacuum-relief valve in a floating roof in which the floating roof is in the maintenance position with the vacuum-relief valve open.

At the top of the body 2 is an upper stop flange 7, and at the bottom there is a lower stop 8. The perimeter of the upper body stop 7 overlies the casing so as to enable the upper body stop to rest on the top of the casing 1, when the floating roof 5 is at a height which permits this. Thus the upper rim of the casing 1 serves as a valve seat and the upper body stop 7 serves as a valve member of the vacuum-relief valve 30 (in that the valve is closed when the upper body stop 7 is resting on the upper rim of the casing 1). This position is shown in FIGS. 1 and 3 where the upper body stop 7 of the body 2 is resting on the top of the casing 1 and closing off communication between the inside of the tank and the outside atmosphere. In order to guarantee a perfect seal, at least one of the regions of contact between the upper body stop 7 and the top of the casing 1 may be covered with some type of sealing material.

An upper portion 21 of the body 2 extends upwardly beyond the upper body stop 7 and has rigidly fastened to it vertical spaced apart plates 12 which have orifices 13 intended to allow the passage of the locking pin 4, this situation occurring when the floating roof is placed in maintenance mode, as will be seen hereinbelow.

The body 2 is hollow, which enables the shaft 3 to be mounted inside it, so as to slide freely. This shaft 3 is substantially vertical and has an upper shaft stop 9 and a lower shaft stop 10.

The shaft 3 also has fastening means for fastening the locking pin 4. In the present embodiment, use is made of a threaded orifice 16, located in the upper shaft stop 9, to fulfil this function, as will be seen hereinbelow. The threaded orifice 16 may be seen in the detail view 2A taken on section A—A of FIG. 2.

Figure 5:
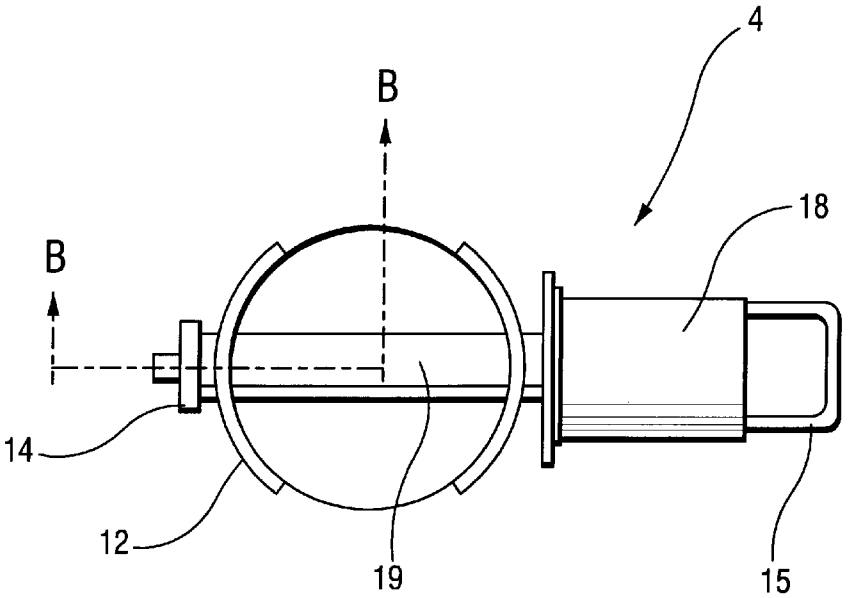
FIG. 5 is a cross sectional view of a locking pin on a vacuum-relief valve showing the locking pin in greater detail.

The locking pin 4, which may be seen better in FIG. 5, comprises a body 18 which has, on its upper end, means for handling the locking pin 4. In the present embodiment this is a handle 15.

A shaft 19 has one of its ends rigidly fastened to the centre of the end of the body 18. At the other end of the shaft 19 is a stop flange 14. The locking pin 4 may be fastened to the shaft 3, in this case by means of a threaded pin 17, rigidly fastened to the stop flange 14.

In FIG. 1, the vacuum-relief valve 30 is installed in the floating roof 5, which is in operating mode and is in an intermediate position. It may be seen that the upper shaft stop 9 of the shaft 3 is resting on the upper portion 21 of the body 2, and the threaded pin 17 of the locking pin 4 is threaded into the threaded orifice 16 of the upper shaft stop 9.

Assuming that the tank is in operation, and that the level of liquid is falling, the floating roof 5 will consequently descend. At a specific moment, the bottom of the shaft 3 touches the floor 11 of the tank and the shaft 3 then begins to move axially inside the body 2. As a result of this movement, the further the floating roof 5 descends the closer will the lower body stop 8 of the body 2 approach the lower shaft stop 10.

When the floating roof 5 has descended as far as the minimum operating height, the support legs of the roof touch the floor 11 of the tank and therefore support the roof. Shortly before this contact between the support legs and the tank floor 11 occurs, the lower body stop 8 will touch the lower shaft stop 10. From this moment onwards, the shaft 3 is prevented from continuing to move upwardly inside the body 2 and the two components remain secured together and stationary relative to the tank floor whilst the floating roof 5 continues to descend.

The casing 1 is rigidly fastened to the floating roof 5 and accompanies it in its descending movement. As the valve body 2 remains stationary relative to the tank floor 11, relative movement between it and the casing 1 then begins to occur, and the upper body stop 7 is prevented from continuing to rest on the top rim of the casing 1. These components 7 and 1 then separate, which causes the vacuum-relief valve 30 to open as may be seen in FIG. 2.

The distance "X" between the lower end of the shaft 3 and the lower shaft stop 10 is greater than the height of the lower body stop 8 above the tank floor 11 when the vacuum-relief valve is closed and the roof 5 is at its minimum operating height, which guarantees that the vacuum-relief valve 30 will open moments before the floating roof 5 descends as far as the minimum operating height, preventing the formation of a vacuum between the layer of liquid and the floating roof 5.

When the floating roof 5 again rises, the casing 1 will accompany it and, as a result, there will be further relative axial movement between it and the body 2, this time in the opposite direction. When the floating roof reaches a height at which the distance of the lower body stop 8 above the tank floor 11 is equivalent to the distance "X", the upper body stop 7 will once again come into contact with the top of the casing 1, closing the vacuum-relief valve.

In order to place the floating roof 5 in the maintenance mode, it has to be raised further to a level at which its support legs can be adjusted to support it in the maintenance position. The various vacuum-relief valves must also be adjusted to operate in this mode. The support legs are of the type disclosed in our International Patent Application PCT/BR98/00007 of Feb. 17, 1998.

To this end, the shaft 19 of the locking pin 4 is passed through the orifices 13 of the plates 12, as shown in FIG. 3. These orifices 13 have dimensions which allow the passage of the stop flange 14 of the shaft 19 with a slight clearance. Since its length is such that the stop flange 14 passes through the entire gap between the plates 12 and passes to the external side, as may be seen in detail in FIG. 5, the shaft 19 rests on the lower peripheries of the orifices 13.

Figure 5A:
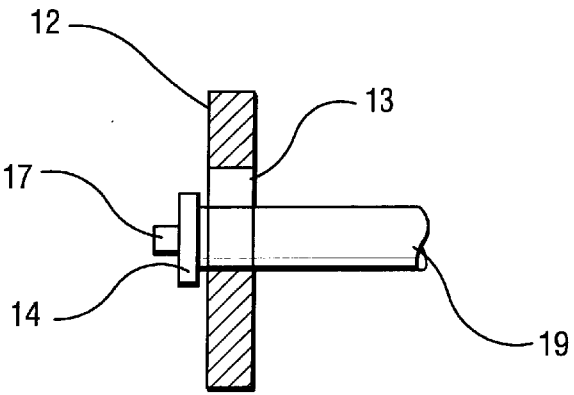
FIG. 5A is a cross sectional view taken along line B—B of FIG. 5.

The body 18 is too wide to pass through the orifices 13 and it acts as a travel limiter for the locking pin 4. As may be seen in detail in FIG. 5A taken on section B—B of FIG. 5, the stop flange 14 has a cross section which is greater than the cross section of the shaft 19 so the locking pin 4 is prevented from moving axially to either of the two sides and it then acts as a stop for limiting upward movement of the shaft 3 relative to the body 2, as may be seen in FIGS. 3 and 4.

In FIG. 3, the vacuum-relief valve 30 is shown in a position in which the floating roof 5 of the storage tank is ready to descend to the maintenance height.

As the roof descends, the bottom of the shaft 3 touches the floor 11 of the tank slightly before the support legs. As the locking pin 4 prevents the shaft 3 from sliding inside the body 2, these two components 2 and 3 are secured together and stationary, although the floating roof 5 continues to descend as far as the maintenance position.

With the floating roof 5 continuing its descending movement relative to the body 2, as far as the maintenance position, the casing 1 accompanies it and relative axial movement begins to occur between the body 2 and the casing 1. The upper body stop 7 of the body 2 is prevented from continuing to rest on the top of the casing 1 and these components 2 and 7 then separate, causing the vacuum-relief valve 30 to open, as may be seen in FIG. 4.

The distance "Y" (FIG. 4) between the lower end of the shaft 3 and the upper shaft stop 9 is greater than the distance between the upper shaft stop 9 and the tank floor 11 at the maintenance height, which guarantees opening of the vacuum-relief valve 30 before the floating roof 5 has descended as far as the maintenance height.

In order to position the valve once again so that it can operate with the floating roof in operating mode, the floating roof has to be raised up to a height at which there is no longer any contact between the floor 11 of the tank and the bottom of the shaft 3, so that the upper shaft stop 9 of the shaft 3 rests on the body 2. It will then suffice to withdraw the locking pin 4 and place it in its original position.

In addition to the function described above, the locking pin 4 can also indicate to a remote observer the status of the vacuum-relief valve operating mode or maintenance mode, as will be seen hereinbelow.

While the floating roof is in the operating mode, the locking pin 4 will always remain in the vertical position. When the floating roof 5 is placed in the maintenance mode, the locking pin 4 is in a position which is transverse to the longitudinal axis of the shaft 3.

Therefore, simple observation of the position of the locking pin 4 enables an operator to determine the operational status of each vacuum-relief valve 30. This observation may, for example, be made from a high, tank-side platform, it then being unnecessary for the operator to descend as far as the floating roof to check the status of each of the vacuum-relief valves, an operation which may be hazardous owing to the large dimensions of the storage tanks.

Optionally, the locking pin 4 may be painted with some type (e.g. colour) of paint to facilitate remote observation, which would further facilitate the operator's task.

It should be pointed out that, while the floating roof 5 of the storage tank is in the operating mode, the locking pin 4 may be stored at any location, since, in this situation, the only function it has is to act as an element for indicating the operational status, as described hereinabove. In this case, it would be needed for use only when the tank was placed in maintenance mode.

By using this procedure, a smaller quantity of locking pins could be used for a large number of storage tanks since, normally, few or even no tanks in a tank facility are in maintenance mode while the rest are operating.

In conclusion, the invention which is the subject of the present specification has major advantages in comparison with the prior art, in addition to having the characteristic of indicating the operational status of the vacuum-relief valve to a remote observer.

What is claimed is:

1. A vacuum-relief valve (30), mounted in a floating roof (5) of a liquid storage tank, said roof having support legs for supporting it in any operational condition, characterized in that it comprises:

a substantially vertical, hollow casing (1) which is rigidly fastened to the floating roof (5);

a substantially vertical, hollow body (2) installed inside the casing (1), where it can move freely in an axial direction, said body (2) having at the bottom a lower body stop (8) and at the top an upper body stop (7), which can rest on the top of the casing (1) and serve as a valve member closing off communication between the inside and the outside of the storage tank when the floating roof (5) is at a height which permits this;

an upper portion (21) of the body (2) extending beyond the upper body stop (7); and a substantially vertical shaft (3) mounted inside the body (2), where it can move freely axially, said shaft (3) having means (4) for fastening it relative to the body (2) and also having an upper shaft stop (9) co-operable with the upper portion (21) of the body (2) for limiting downward axial travel of the shaft (3) relative to the body (2), and a lower shaft stop (10) co-operating with the lower body stop (8) for limiting the axial upward movement of the shaft (3) relative to the body (2);

in that the distance "X" between the lower end of the shaft (3) and the lower shaft stop (10) is greater than the height of the lower body stop (8) above the tank floor (11) when the valve (30) is closed and the floating roof (5) is at a minimum operating height;

in that the distance "Y" between the lower end of the shaft (3) and the upper shaft stop (9) is greater than the height of the upper end of the upper portion (21) above the tank floor (11) when the floating roof is in maintenance mode, resting on its support legs;

in that with the fastening means (4) inoperative so as to allow axial movement of the shaft (3) relative to the body (2) so the floating roof (5) is in the operating mode, when the level of liquid inside the storage tank descends as far as a level at which the lower body stop (8) is at a height above the tank floor (11) equivalent to the distance "X", the lower end of the shaft (3) touches the floor (11) of the storage tank and the shaft (3) begins to rise inside the body (2), forcing the lower shaft stop (10) to contact the lower body stop (8) so that the shaft (3) stops its axial movement and the body (2) and the shaft (3) remain together and stationary, whilst the floating roof (5) and the casing (1) secured thereto continue to descend so that the body (2) begins to rise axially inside the casing (1) and causes the upper body stop (7) and the top of the casing (1) to move apart, thereby opening the vacuum-relief valve (30);

and in that, with the fastening means (4) operative to secure the shaft (3) axially relative to the body (2) to adjust the vacuum-relief valve (30) to operate with the floating roof (5) in maintenance mode, when the level of liquid inside the storage tank descends as far as a level where the floating roof (5) is at a level where the height of the top of the upper portion (21) of the body (2) above the tank floor (11) is equivalent to the distance "Y", the lower end of the shaft (3) touches the floor (11) of the tank and, as the shaft (3) is prevented from axial movement inside the body (2), the shaft and body remain stationary so that the floating roof (5) continues to descend, and axial movement occurs between the body (2) and the casing (1) which separates the top of the casing (1) and the upper body stop (7), thereby opening the vacuum-relief valve (30).

2. A vacuum-relief valve according to claim 1, characterized in that the body (2) has fins (6) which guide the body (2) during movement within the casing (1) to keep the longitudinal axis of the body (2) parallel to the longitudinal axis of the casing (1).

3. A vacuum-relief valve according to claim 1, characterized in that at least one region of contact between the upper body stop (7) and the top of the casing (1) is covered with sealing material.

4. A vacuum-relief valve according to claim 1 wherein the fastening means (4) comprise:

a locking pin which has means which enable it to be fastened to the shaft (3), and comprises a body (18) which has at a first end a shaft (19) which is rigidly fastened to the body (18) and which has a stop flange (14) at its distal end;

in that the upper portion (21) of the body (2) has rigidly fastened to it plates (12) which have orifices (13);

in that the shaft (19) of the locking pin is able to pass through the orifices (13) of the plates (12), the orifices having dimensions which allow the passage of the stop flange (14) of the shaft (19) to pass through them with clearance, so that the shaft (19) then rests on the lower peripheries of the orifices (13), since the length of the shaft is such that the stop flange (14) passes across the entire gap between the plates (12) and to the external side;

in that the body (18) has dimensions which are greater than those of the orifices (13) and it acts as a travel limiter for the locking pin; and in that, as the stop flange (14) has a cross section which is greater than the cross section of the shaft (19), the locking pin is prevented from moving axially in either direction and it then acts as a stop for the shaft (3), preventing the shaft from sliding inside the body (2), thereby securing together the shaft (3) and body (2).

5. A vacuum-relief valve according to claim 4, characterized in that the position of the locking pin gives to a remote observer a visual indication of the operational status of the vacuum-relief valve (30).

6. A vacuum-relief valve according to claim 4, characterized in that the locking pin is painted with a type of paint which enables the locking pin to be seen from a distance.

7. A vacuum-relief valve according to claim 4, characterized in that the body (2) has fins (6) which guide the body (2) during movement within the casing (1) to keep the longitudinal axis of the body (2) parallel to the longitudinal axis of the casing (1).

8. A vacuum-relief valve according to claim 4, characterized in that at least one region of contact between the upper body stop (7) and the top of the casing (1) is covered with sealing material.

9. A vacuum-relief valve according to claim 4, characterized by a handle for the locking pin, positioned at the second end of the body (18) of the locking pin.

10. A vacuum-relief valve according to claim 9, characterized in that the locking pin is painted with a type of paint which enables the locking pin to be seen from a distance.

11. A vacuum-relief valve according to claim 9, characterized in that the position of the locking pin gives to a remote observer a visual indication of the operational status of the vacuum-relief valve (30).

12. A vacuum-relief valve according to claim 9, characterized in that the body (2) has fins (6) which guide the body (2) during movement within the casing (1) to keep the longitudinal axis of the body (2) parallel to the longitudinal axis of the casing (1).

13. A vacuum-relief valve according to claim 9, characterized in that at least one region of contact between the upper body stop (7) and the top of the casing (1) is covered with sealing material.

14. A vacuum-relief valve according to claim 4, characterized in that a threaded pin (17) is rigidly fastened to the stop flange (14) of the locking pin (4), and a threaded orifice (16) is located in the upper shaft stop (9); whereby the threaded pin (17) can be screwed into the threaded orifice (16) when it is necessary to fasten the locking pin (4) to the shaft (3).

15. A vacuum-relief valve according to claim 14, characterized in that the locking pin is painted with a type of paint which enables the locking pin to be seen from a distance.

16. A vacuum-relief valve according to claim 14, characterized in that the position of the locking pin gives to a remote observer a visual indication of the operational status of the vacuum-relief valve (30).

17. A vacuum-relief valve according to claim 14, characterized in that the body (2) has fins (6) which guide the body (2) during movement within the casing (1) to keep the longitudinal axis of the body (2) parallel to the longitudinal axis of the casing (1).

18. A vacuum-relief valve according to claim 14, characterized in that at least one region of contact between the upper body stop (7) and the top of the casing (1) is covered with sealing material.

* * * * *